US006584898B2

(12) United States Patent
Reinholdt

(10) Patent No.: US 6,584,898 B2
(45) Date of Patent: Jul. 1, 2003

(54) PAD-PRINTING INK CUP

(75) Inventor: Holger Reinholdt, Freudenstadt (DE)

(73) Assignee: ITW Morlock GmbH, Baiersbrown (DE)

( * ) Notice: Subject to any disclaimer, the term of this patent is extended or adjusted under 35 U.S.C. 154(b) by 0 days.

(21) Appl. No.: 09/875,951

(22) Filed: Jun. 8, 2001

(65) Prior Publication Data

US 2001/0052300 A1 Dec. 20, 2001

(30) Foreign Application Priority Data

Jun. 9, 2000 (DE) ..... 100 28 551

(51) Int. Cl.[7] ..... B41F 1/00; B41F 1/40; B41F 31/14; B41K 1/42; B41L 41/00

(52) U.S. Cl. ..... 101/163; 101/167; 101/169; 101/324; 101/333; 101/335; 101/338; 101/359; 101/423

(58) Field of Search ..... 101/333, 423, 101/41, 310, 324, 335, 338, 359, 163, 167, 169

(56) References Cited

U.S. PATENT DOCUMENTS

| | | | | |
|---|---|---|---|---|
| 5,237,922 A | * | 8/1993 | Ho | 101/333 |
| 5,392,706 A | * | 2/1995 | Drew, II et al. | 101/170 |
| 5,537,921 A | * | 7/1996 | Adner et al. | 101/35 |
| 5,662,041 A | * | 9/1997 | Kleist | 101/163 |
| 5,893,326 A | * | 4/1999 | Wong | 101/170 |

FOREIGN PATENT DOCUMENTS

| | | |
|---|---|---|
| DE | 4015684 A1 | 5/1990 |
| DE | 4210521 A1 | 3/1992 |
| DE | 19502802 A1 | 1/1995 |
| DE | 19644366 A1 | 10/1996 |
| EP | 0315769 B1 | 9/1988 |
| EP | 0347762 B1 | 6/1989 |
| EP | 0945266 A1 | 4/1998 |
| WO | 93/04862 | 3/1993 |
| WO | 99/07556 | 2/1999 |

* cited by examiner

*Primary Examiner*—Stephen R. Funk
*Assistant Examiner*—Marvin P. Crenshaw
(74) *Attorney, Agent, or Firm*—Lowe Hauptman Gilman & Berner, LLP

(57) ABSTRACT

The invention concerns a pad-printing ink cup fitted with at least one magnet (10). The minimum of one magnet (10) may be positioned at different heights relative to the plane of the doctor edge (22), the magnetic force effective in the said plane depending on said heights.

25 Claims, 1 Drawing Sheet

PAD-PRINTING INK CUP

TECHNICAL FIELD

The invention relates to a pad-printing ink cup fitted with at least one magnet.

BACKGROUND OF THE INVENTION

A pad-printing ink cup is known from the European patent document EP 0 347 762 B 1. In a pad printing machine, the ink cup sits on a printing plate containing recesses in the form of a print picture to be transferred. The ink from the ink cup penetrates the recesses. The printing plate is displaceable underneath the ink cup and as a result the recesses constituting the picture to be transferred a first time shall be situated underneath the ink cup and another time underneath a printing pad (tampon). The pad is lowered onto the ink-filled recesses from which it removes the ink and hence the print image which it transfers—once the printing plate has been moved out of the pad's vicinity—onto an object to be printed. A pad printing machine is known for instance from the European patent document EP 0 315 769 B 1, (U.S. Pat. No. 4,905,594).

The following documents contain further state of the art: DE 196 44 366 A1; DE 195 02 802 A1; DE 42 10 521 A1; DE 40 15 684 A1; EP 0 945 266 A1; WO 99 07 556 A1 and WO 93 04 862 A1.

Printing plates illustratively are made of metal or plastic.

Depending on the printing-plate surface material, a hard or soft ink cup doctor edge, shall be advantageous. The doctor edge may be constituted by the very wall of the ink cup or by means of a doctor ring affixed to the ink cup wall. The doctor edge may consist of a metal, a plastic or ceramic or another material.

Depending on the material of the printing-plate surface and of the doctor's edge, this edge may be pressed more or less hard against said surface to prevent ink from leaking between the doctor edge and the printing-plate surface. The higher the printing rate (image transfer from printing plate to an object being printed), the more rapidly the ink cup must be moved above the printing plate. However speeds entail dynamic pressures inside the doctor and there will be a commensurate danger of the ink leaking between the printing-plate surface and the doctor edge, or that it will float on the printing-plate ink (aquaplaning). As a result, and depending on the materials of the doctor edge and printing-plate surface and on the printing rate, the doctor edge may have to be pressed harder against the printing-plate surface in order to avoid unduly high friction on one hand and on the other hand to assure cleanly wiping the ink from the printing-plate surface.

SUMMARY OF THE INVENTION

This problem is solved by a pad-printing ink cup fitted with a cup structure open at its bottom and at the lower end of its wall with a doctor edge to wipe the ink off a printing plate, and further fitted with a magnet situated in the lower zone of the ink cup to attract this ink cup against the printing plate, the ink cup being characterized in that the minimum of one magnet is displaceable relative to the plane of the doctor edge to assume different heights from the plane, the magnetic force effective in the doctor edge plane varying with height.

In particular the invention offers the following advantages:

The invention allows adjusting in simple manner the magnetic force by which the doctor edge is attracted against the printing-plate surface. In this manner the compression of the doctor edge against the printing-plate surface can be matched to various materials which in practice are used for the doctor edge and/or the printing-plate surface. Moreover the compression against the printing-plate surface can be matched to the various viscosities of the inks in the ink cup and deposited by said ink cup on said plate. Thus the same ink cup can be used for different kinds of printing plates. Henceforth it will no longer be necessary to use different ink cups for different printing plates. Advantageously the doctor edge shall be an exchangeable element allowing affixing different doctor edges to the ink cup wall to match different kinds of printing plates and different kinds of inks or ink viscosities.

BRIEF DESCRIPTION OF THE DRAWINGS

The invention is elucidated below by means of an illustrative embodiment and in relation to the drawings.

DETAILED DESCRIPTION OF THE INVENTION

Figure 1:
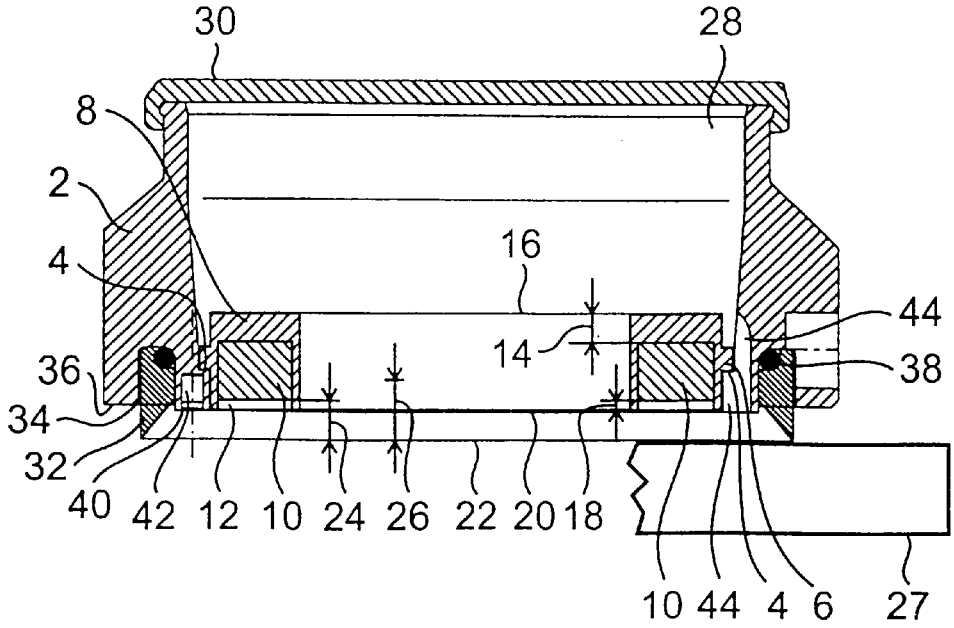
FIG. 1 is a vertical section of a pad-printing ink cup along the plane II—II of FIG. 2.
Figure 2:
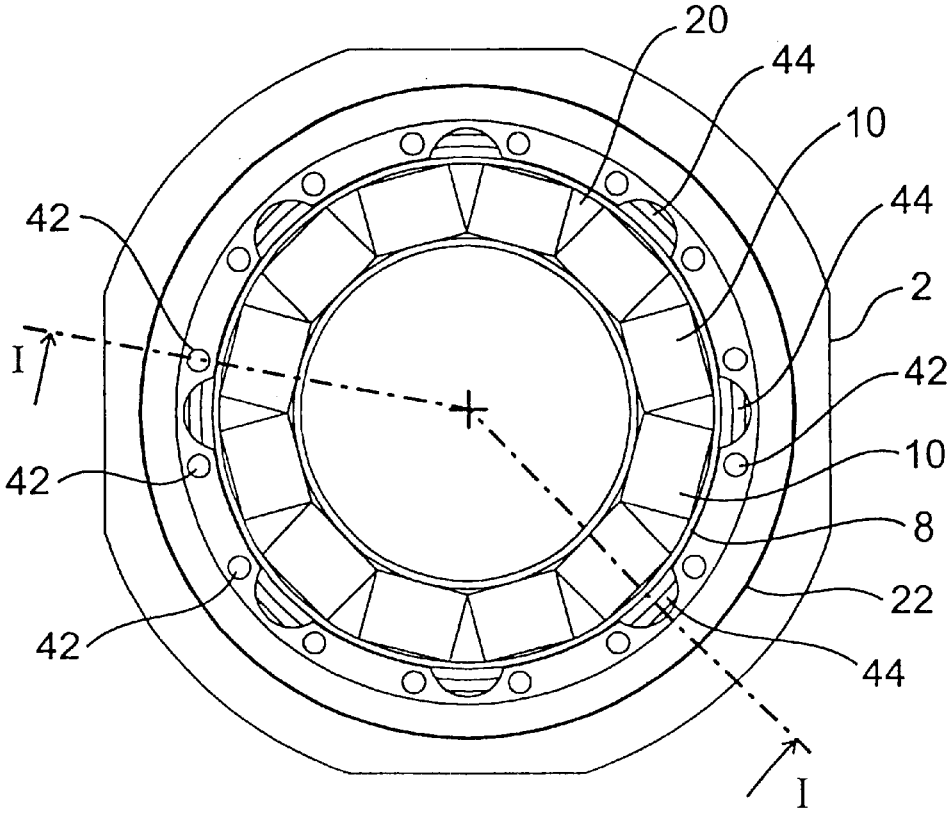
FIG. 2 is a bottom view of the pad-printing ink cup of FIG. 1.

The pad-printing ink cup of the invention shown in the Figures comprises, as seen in horizontal cross-section, a preferably substantially cylindrical wall 2 fitted at its inside and in the lower zone with an annular salient 4 (offset) projecting radially inward and supporting an annular external circumferential rib 6 of a an annular magnet holder 8. A plurality of permanent magnets 10 is integrated into the annular magnet holder and preferably these are bonded in place by a curing adhesive 12. Instead of an annular salient 4 running over 360° and/or an annular external circumferential rib 6, salients or ribs running over only a small part of the circumference may also be used.

The external circumferential rib 6 is situated approximately at the half-height of the annular magnet holder 8. The height differential 14 between the permanent magnets 10 and the top side 16 of the annular magnet holder 8 is larger than their distance 18 to the bottom side 20 of the annular magnet holder 8. Therefore the height differential between the permanent magnets 10 and the plane containing a doctor edge 22 is a lesser height differential 24 in the embodiment of FIG. 1 when the top side 16 of the annular magnet holder 8 points upward than in a reversed position of the annular magnet holder 8 wherein its top side 16 points down, and its bottom side 20 points up, resulting in a larger height differential 26 between the permanent magnets 10 and the plane of the doctor edge 22.

Accordingly the force exerted by the permanent magnets 10 in their upright positions shown in the plane of the doctor edge 22 in FIG. 1 shall be larger than in the omitted, that is the upside down position of the annular magnet holder 8. In one case the doctor edge 22 (FIG. 1) is attracted more strongly and in the other case more weakly toward the surface of a printing plate 27 against the surface of a printing plate by a magnetizable body, in particular iron, which may be the printing plate per se or another part added to it, preferably underneath.

The height differentials and the height of the external circumferential rib 6 relating to the top side 16 and bottom side 20 of the annular magnet holder 8 determine the magnetic force in the upright position shown in FIG. 1 and in the omitted, upside down position of the annular magnet holder 8.

The distance between the permanent magnets 10 and the doctor edge 22 also can be adjusted using annular spacers between the annular inner salient 6 of the cup wall 2 and the external circumferential rib 4 and thereby also the magnetic force in the plane of the doctor edge.

The ink cup is wide open at the bottom and the ink it contains can freely flow down through the annular magnet holder 8 onto a permitting plate 27. The ink cup also comprises an open upper end 28 which can be sealed by a lid 30 attached to the cup wall 2 and be reopened to refill ink into the cup.

The doctor edge 22 may consist of the lower end of the cup wall 2. In the shown, preferred embodiment, the doctor edge 22 assumes the form of an annular doctor 32 inserted in exchangeable manner into an annular channel 34 in the lower end face 36 of the cup wall 32 and illustratively being sealed by a seal 38.

Magnetizable metal, preferably iron pins 42 are inserted into boreholes 40 in the lower end face 36 and are magnetically attracted by the permanent magnets 10. As a result the annular magnet holder 8, that is its external circumferential rib 6, is magnetically pulled down against the magnetic salient 4 of the cup wall 2 and thereby it is also retained at said annular salient 4 both in the cup's axial and circumferential direction, when the ink cup is turned upside down. The permanent magnets 10 might be replaced by electromagnetic ones, though this feature so far remains unconventional.

A plurality of circumferentially distributed overflow ducts 44 are present between the cup wall 2 and the annular magnet holder 8 and run from the bottom side 20 to the top side 16 of said holder 8, allowing ink subjected to dynamic pressure during doctoring to flow from the inside of the doctor edge 22 through these ducts from the bottom side 20 to the top side 16. In the embodiment shown in the Figures, the overflow ducts 44 are in the form of channels running axially in the inside of the cup wall 2 and opposite the annular magnet holder 8. In another embodiment mode, such ducts also may instead or additionally be present in the annular magnet holder 8.

When seen in horizontal cross section, the cup wall 2 preferably exhibits a cylindrical cross-section, though this cross-sectional contour may vary in other embodiment modes. Preferably the cup wall 2 is made of a non-magnetic material such as aluminum or plastic.

What is claimed is:

1. A pad-printing ink cup, comprising:

a cup wall made of a non-magnetizable material and having a lower end portion that defines an open end of said ink cup;

a doctor edge projecting downwardly from the lower end portion of said cup wall and circumscribing said open end for wiping ink off a printing plate;

a magnet holder being supported by said cup wall;

at least one magnet held by said magnet holder and adapted to magnetically attract the ink cup against the printing plate; and an element made of a magnetizable material, affixed to said cup wall, and magnetically attracting said at least one magnet.

2. The ink cup of claim 1, wherein a magnetic attracting force between said element and said at least one magnet is sufficient to retain said at least one magnet in position even when said ink cup is turned upside down.

3. The ink cup of claim 2, wherein said at least one magnet is adjustably supported by said cup wall at different elevational positions relative to a plane containing said doctor edge.

4. The ink cup of claim 1, wherein said element magnetically attracts said at least one magnet in a radial direction of said ink cup.

5. The ink cup of claim 1, wherein said element and said at least one magnet are separated by a portion of said cup wall.

6. The ink cup of claim 5, wherein said magnet holder is completely received within an interior of said ink cup as defined by said cup wall.

7. The ink cup of claim 1, wherein the lower end portion of said cup wall has at least one cavity open downwardly, said element comprising an iron pin placed in said at least one cavity.

8. The ink cup of claim 7, wherein a wall of said at least one cavity is formed as a projection projecting from said cup wall radially and inwardly to define a support for said at least one magnet.

9. The ink cup of claim 7, comprising a plurality of said magnets and said pins arranged circumferentially of said cup wall at regular intervals.

10. A pad-printing ink cup, comprising:

a cup wall having a lower end portion that defines an open end of said ink cup;

a doctor edge projecting downwardly from the lower end portion of said cup wall and circumscribing said open end for wiping ink off a printing plate;

a magnet holder being supported by said cup wall;

at least one magnet adapted to magnetically attract the ink cup against the printing plate, said at least one magnet being held by said magnet holder so as to be completely received within an interior of said ink cup as defined by said cup wall; and at least one overflow duct communicating a lower side and an upper side of said at least one magnet for allowing ink to flow, along an inner side of said doctor edge and through said overflow duct, from the lower side to the upper side of said at least one magnet when said ink is pressurized by a dynamic pressure during a doctor operation of said doctor edge.

11. The ink cup of claim 10, wherein said at least one overflow duct is configured between said cup wall and said at least one magnet.

12. The ink cup of claim 11, wherein said at least one magnet is adjustably supported by said cup wall at different elevational positions relative to a plane containing said doctor edge.

13. The ink cup of claim 10, wherein said at least one overflow duct is formed as a plurality of channels running axially in an inside of said cup wall.

14. The ink cup of claim 10, wherein said magnet holder is completely received within the interior of said ink cup, and said at least one overflow duct is formed in said magnet holder.

15. A pad-printing ink cup, comprising:

a lid;

a cup wall having an upper end portion and a lower end portion, said lid being removably attached to the upper end portion of said cup wall to define a closed end of said ink cup, the lower end portion of said cup wall defining an open end of said ink cup;

a doctor edge projecting downwardly from the lower end portion of said cup wall and circumscribing said open end for wiping ink off a printing plate;

a magnet holder completely received within an interior of said ink cup as defined by said cup wall, said magnet holder being sized and shaped so as to be insertable through an opening defined by the upper end portion of said cup wall when said lid is removed; and at least one magnet held by said magnet holder and adapted to magnetically attract the ink cup against the printing plate;

said magnet holder being adjustably supported by said cup wall so that said at least one magnet assumes different elevational positions relative to a plane containing said doctor edge.

16. The ink cup of claim 15, wherein said cup wall has an inner projection projecting inwardly inside the interior of said ink cup, said magnet holder resting on and being supported by said inner projection.

17. The ink cup of claim 16, wherein said magnet holder has a top side and a bottom side, said magnet assumes one of said elevational positions when said magnet holder is supported by said inner projection with the top side facing upward and another of said elevational positions when said magnet holder is supported by said inner projection with the top side facing downward.

18. The ink cup of claim 16, further comprising at least one spacer removably inserted between said inner projection and said magnet holder to adjust a spacing between said at least one magnet and the plane containing said doctor edge.

19. The ink cup of claim 16, wherein said at least one magnet is either permanent or electromagnetic.

20. The ink cup of claim 16, wherein said cup wall is made of a non-magnetizable material, said ink cup further comprising at least one an element made of a magnetizable material, affixed to said cup wall, and magnetically attracting said at least one magnet with a magnetic attracting force that is sufficient to retain said at least one magnet in at least one of said elevational positions even when said ink cup is turned upside down.

21. The ink cup of claim 16, further comprising a plurality of overflow ducts configured between said cup wall and said magnet holder for allowing ink to flow, along an inner side of said doctor edge and through said overflow ducts, from a lower side to an upper side of said magnet holder when said ink is pressurized by a dynamic pressure during a doctor operation of said doctor edge.

22. The ink cup of claim 16, wherein said doctor edge is removably attached to said cup wall.

23. The ink cup of claim 16, wherein said magnet holder has an outer projection outwardly projecting toward said clip wall, said outer projection rests on said inner projection of said cup wall to fix said magnet in one of said elevational positions.

24. The ink cup of claim 23, wherein said outer projection has opposite first and second surface, said magnet assumes one of said elevational positions when said magnet holder is supported by said inner projection with the first surface of said outer projection resting on said inner projection and another of said elevational positions when said magnet holder is supported by said inner projection with the second surface of said outer projection resting on said inner projection.

25. The ink cup of claim 15, wherein a maximum diametrical extent of said magnet holder is not greater than a diameter of the opening defined by the upper end portion optical fiber cup wall.

* * * * *